US007308220B2

(12) United States Patent
Asaoka et al.

(10) Patent No.: US 7,308,220 B2
(45) Date of Patent: Dec. 11, 2007

(54) BELT UNIT OF ELECTROPHOTOGRAPHIC PRINTING APPARATUS

(75) Inventors: Akira Asaoka, Ibaraki (JP); Isao Nakajima, Ibaraki (JP); Akihiko Yamazaki, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 10/781,820

(22) Filed: Feb. 20, 2004

(65) Prior Publication Data

US 2004/0165909 A1 Aug. 26, 2004

(30) Foreign Application Priority Data

Feb. 21, 2003 (JP) ..... P. 2003-043476
Jan. 16, 2004 (JP) ..... P. 2004-009072

(51) Int. Cl.
*G03G 15/02* (2006.01)

(52) U.S. Cl. ..... 399/116; 399/165; 399/162; 399/350

(58) Field of Classification Search ..... 399/116, 399/165, 162, 288, 313, 164, 303
See application file for complete search history.

(56) References Cited

U.S. PATENT DOCUMENTS 4,170,175 A * 10/1979 Conlon, Jr. ..... 399/288
4,630,920 A * 12/1986 Silverberg et al. ..... 399/164
5,172,175 A * 12/1992 Sekino et al. ..... 399/303
5,426,485 A * 6/1995 Fujita et al. ..... 399/350
5,604,570 A * 2/1997 Jeran et al. ..... 399/116
5,655,205 A * 8/1997 Ziegelmuller et al. ..... 399/350
5,666,623 A * 9/1997 Yamada et al. ..... 399/320
6,078,766 A * 6/2000 Kurotaka ..... 399/165
6,269,231 B1 * 7/2001 Castelli et al. ..... 399/165
6,397,033 B1 * 5/2002 Todome ..... 399/303

FOREIGN PATENT DOCUMENTS

JP 5-19667 1/1993

* cited by examiner

*Primary Examiner*—David M. Gray
*Assistant Examiner*—Ryan D. Walsh
(74) *Attorney, Agent, or Firm*—McGinn IP Law Group, PLLC

(57) ABSTRACT

A belt unit of an electrophotographic printing apparatus, includes: two rollers for supporting a belt so as to be substantially in parallel with each other; two frames for supporting the rollers and attached to opposite ends of one of the rollers respectively so as to be perpendicular to the rollers; two support members attached to opposite ends of the other roller so as to be perpendicular to the rollers; two elastic members interposed between the two support members and the two frames respectively; and a belt mounting guide provided between the two frames. The belt mounting guide includes a rotating shaft disposed in parallel with the rollers, and an edge portion inclined relative to an axial direction of the rotating shaft.

20 Claims, 2 Drawing Sheets

BELT UNIT OF ELECTROPHOTOGRAPHIC PRINTING APPARATUS

BACKGROUND OF THE INVENTION

1. Field of the Invention

The present invention relates to a belt unit of an electrophotographic printing apparatus.

2. Background Art

Here will be described a belt unit, especially a belt photoconductor unit in an electrophotographic printing apparatus according to the related art.

As a general configuration of a belt photoconductor unit, there is known a configuration in which a drive roller for rotating a belt photoconductor and a tension roller having tension urged by springs or the like are provided between two frames for supporting the rollers and in which the belt photoconductor is wound around the rollers.

The belt photoconductor unit is configured so that a sensor for detecting a widthwise end of the belt photoconductor is provided on one of the frames or the like in order to perform detection of misalignment during rotation, detection of a seam of the belt photoconductor, and so on.

The belt photoconductor needs to be exchanged for a new one periodically since it is an expendable article. At the time of exchange, it is necessary to remove the belt photoconductor from the frames and mount a new one. In the related art, it was necessary to shift the tension roller in a direction of narrowing the distance between the drive roller and the tension roller before removal/mounting of the belt photoconductor.

Further, at the time of mounting of the belt photoconductor, the belt photoconductor must be mounted so as to be positioned in a groove of the sensor properly. This work was very difficult. As a related-art technique for setting the belt photoconductor in a proper position, there is known a technique in which: a first cam and a second cam for moving the tension roller in a direction of relaxing the belt photoconductor are provided on opposite ends of a rotating shaft; the length of the first cam is set to be larger than the length of the second cam; slowly increasing tension is applied to the belt photoconductor to thereby mount the belt photoconductor in the groove of the hole sensor (e.g., see JP-A-5-019667 (page 3 and FIG. 3)).

According to the related art, it was structurally difficult to make the length difference between the first and second cams extremely large. For this reason, when a belt photoconductor having a large circumferential length was used, there was the possibility that the belt photoconductor would be scratched so as to be disabled from being used because slackness of the belt photoconductor could not be eliminated reliably to make it impossible to mount the belt photoconductor in the groove of the sensor accurately.

Furthermore, the mounting position of the belt photoconductor was indefinite in the widthwise direction. For this reason, there was the possibility that the belt photoconductor could not exhibit its original performance because the belt photoconductor might be mounted in a position different from the original position where the belt photoconductor should be used. In addition, there was the possibility that the belt photoconductor would be damaged so as to be disabled from being used because the belt photoconductor might come into contact with the sensor.

There was possibility that the belt photoconductor might be inserted into the electrophotographic printing apparatus body while the cams were not restored to their positions at the time of actual printing, that is, to the positions where tension would be applied to the belt photoconductor after the belt photoconductor was mounted. For this reason, there was the possibility that the belt photoconductor was scratched so as to be disabled from being used.

SUMMARY OF THE INVENTION

It is an object of the invention to provide a belt photoconductor unit with a simple configuration that allows a belt to be mounted in a position where a sensor can detect the belt properly without damaging the belt.

To achieve the object, the invention provides a belt unit of an electrophotographic printing apparatus, including: two rollers for supporting a belt so as to be substantially in parallel with each other; two frames for supporting the rollers and attached to opposite ends of one of the rollers respectively so as to be perpendicular to the rollers; two support members attached to opposite ends of the other roller so as to be perpendicular to the rollers; two elastic members interposed between the two support members and the two frames respectively; and a belt mounting guide provided between the two frames; wherein the belt mounting guide includes a rotating shaft disposed in parallel with the rollers, and an edge portion inclined relative to an axial direction of the rotating shaft.

Preferably, a step portion is provided at one end of the edge portion of the belt mounting guide and in a position where the belt travels normally.

Preferably, when the belt is mounted, the belt mounting guide is located to be higher than a frame that forms a slot portion included in an apparatus body in which the belt unit is mounted.

Preferably, the rotating shaft of the belt mounting guide is provided with a blade for cleaning a back surface of the belt.

The invention provides an electrophotographic printing apparatus, including: an apparatus body; and a belt unit installed in the apparatus body; wherein the belt unit includes: a belt, two rollers for supporting the belt so as to be substantially in parallel with each other, two frames for supporting the rollers and attached to opposite ends of one of the rollers respectively so as to be perpendicular to the rollers, two support members attached to opposite ends of the other roller so as to be perpendicular to the rollers, two elastic members interposed between the two support members and the two frames respectively, and a belt mounting guide provided between the two frames; and the belt mounting guide includes a rotating shaft disposed in parallel with the rollers, and an edge portion inclined relative to an axial direction of the rotating shaft.

Preferably, the apparatus body includes a frame that forms a slot portion in which the belt unit is installed; and, when the belt is mounted, the belt mounting guide is located to be higher than the frame.

BRIEF DESCRIPTION OF THE DRAWINGS

The present invention may be more readily described with reference to the accompanying drawings.

DETAILED DESCRIPTION OF THE PREFERRED EMBODIMENTS

An embodiment of the invention will be described below. Although this embodiment will be described on the case in which a belt photoconductor is used, the invention is not limited to the belt photoconductor but may be applied to an intermediate transfer belt, a transfer belt, a fixing belt, etc.

Figure 1:
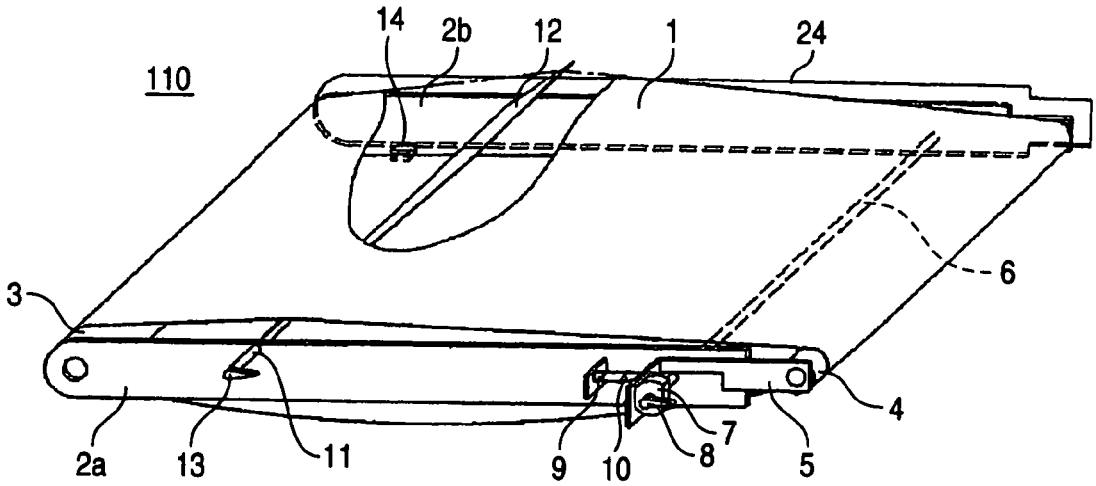
FIG. 1 is a schematic view of a belt mounting mechanism according to the invention.

FIG. 1 is a schematic view of a belt photoconductor unit 110 according to an embodiment of the invention at a point of time when a belt photoconductor used in the belt photoconductor unit 110 is mounted in an electrophotographic printing apparatus.

The belt photoconductor unit 110 according to the embodiment of the invention includes: a belt photoconductor 1 which is a detachably mountable photoconductor shaped like a belt; frames 2*a* and 2*b*; a drive roller 3 for driving the belt photoconductor 1 to rotate; a tension roller 4 for adjusting tension acting on the belt photoconductor 1; and support members 5 for connecting the tension roller 4 to the frames 2*a* and 2*b*. The belt photoconductor unit 110 further includes: a first rotating shaft 6 disposed between the frames 2*a* and 2*b*; cams 7 and a first lever 8 connected to opposite ends of the first rotating shaft 6; springs 9 for applying tension to the tension roller 4 in a direction of moving away from the driver roller 3; and guide shafts 10 for guiding the respective springs 9.

While one of the support members 5, one of the cams 7, one of the springs 9 and one of the guide shafts 10 are attached to the frame 2*a*, the other support member 5, the other cam 7, the other spring 9 and the other guide shaft 10 are attached to the frame 2*b* in the same manner. The tension roller 4 is therefore supported by the support members 5, the cams 7, the springs 9 and the guide shafts 10.

When the first lever 8 is rotated, the cams 7 can be also rotated to move the tension roller 4 and the support members 5 in a direction of tensing or relaxing the belt photoconductor 1 (an axial direction of each guide shaft 10). Each cam 7 used herein is an eccentric cam.

The guide 12 is formed so that its height varies in the widthwise direction of the belt photoconductor 1, that is, the height of the guide 12 increases slowly as the belt photoconductor 1 is mounted more deeply. When second lever 13 is rotated, the guide 12 is also rotated so as to go out or come in.

For example, the sensor 14 is a transmission type sensor which detects meandering of the belt photoconductor 1 when printing is actually performed. The sensor 14 is disposed so that one widthwise end portion of the belt photoconductor 1 faces a U-shaped groove of the sensor 14. Although the description of how to correct meandering will be omitted here, for example, the method described in JP-A-2002-296972 may be used, which is incorporated by reference. In this embodiment, as shown in FIG. 1, the sensor is attached to a position opposite to an end of the lower part of the belt when the belt photoconductor is mounted.

The operation of mounting the belt photoconductor will be described below with reference to FIG. 1.

When the belt photoconductor 1 is mounted, the belt photoconductor 1 is horizontally pulled out from the electrophotographic printing apparatus body not shown, and the first lever 8 is rotated in the direction of relaxing the tension roller 4 as shown in FIG. 1 to thereby mount the belt photoconductor 1. At the same time, the second lever 13 is also rotated to locate the guide 12 in the position shown in FIG. 1.

The guide 12 has a rotating shaft, and an edge portion inclined relative to the shaft.

Because of the shape of the guide 12, the height of the guide 12 increases slowly in the direction of tensing the belt photoconductor 1 as the belt photoconductor 1 is mounted more deeply. As a result, slackness of the lower part of the belt photoconductor 1 is eliminated, so that the belt photoconductor 1 is mounted in the groove of the sensor 14 firmly.

A step portion 12*a* (see FIG. 2) is provided at an end of the guide 12. The end of the belt photoconductor 1 abuts on the step portion 12*a* at the end of the guide 12 as the belt photoconductor 1 is mounted deeply. As a result, the belt photoconductor 1 is aligned with a line along which the belt photoconductor 1 will travel at the time of actual printing.

At the time of mounting of the belt photoconductor, the guide 12 needs to be located in a position (see FIG. 1) protruded upward of the frames 2*a* and 2*b* from its normal position used at the time of actual printing. Therefore, at the time of mounting of the belt photoconductor, the guide 12 is configured so as be higher than a frame 24 that forms each slot portion of the apparatus body 100 (See FIG. 3). In this manner, the guide 12 has a miss-insertion preventing function which prevents the belt from being inserted into the electrophotographic printing apparatus body by mistake in the condition that the belt has not completely mounted yet.

Figure 2:
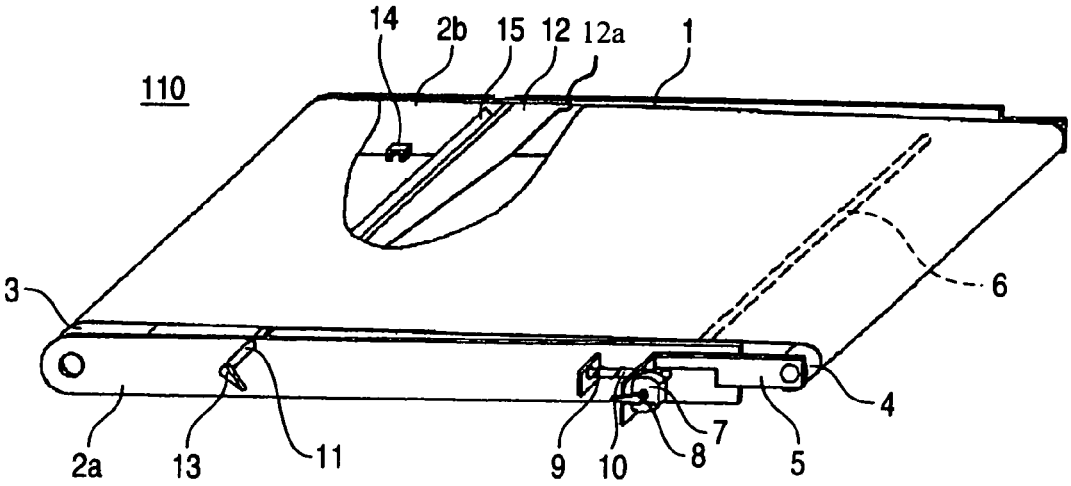
FIG. 2 is a schematic view of the belt mounting mechanism according to the invention at the time of traveling of a belt after mounting of the belt.

FIG. 2 shows a schematic view of the belt photoconductor unit 110 at the time of actual printing.

In FIG. 2, at the time of actual printing, the first lever 8 is rotated to make the tension roller 4 tense the belt photoconductor 1 whereas the second lever 13 is rotated to the position shown in FIG. 2 to prevent the guide 12 from coming into contact with the belt photoconductor 1.

On this occasion, a blade 15 attached to the second rotating shaft 11 is located in a position where the blade 15 comes into contact with a back surface of the belt photoconductor 1. As a result, the blade 15 cleans the back surface of the belt photoconductor 1. The back surface of the belt photoconductor 1 is smeared, for example, with toner scattered at the time of actual printing but can be cleaned by the blade 15.

Figure 3:
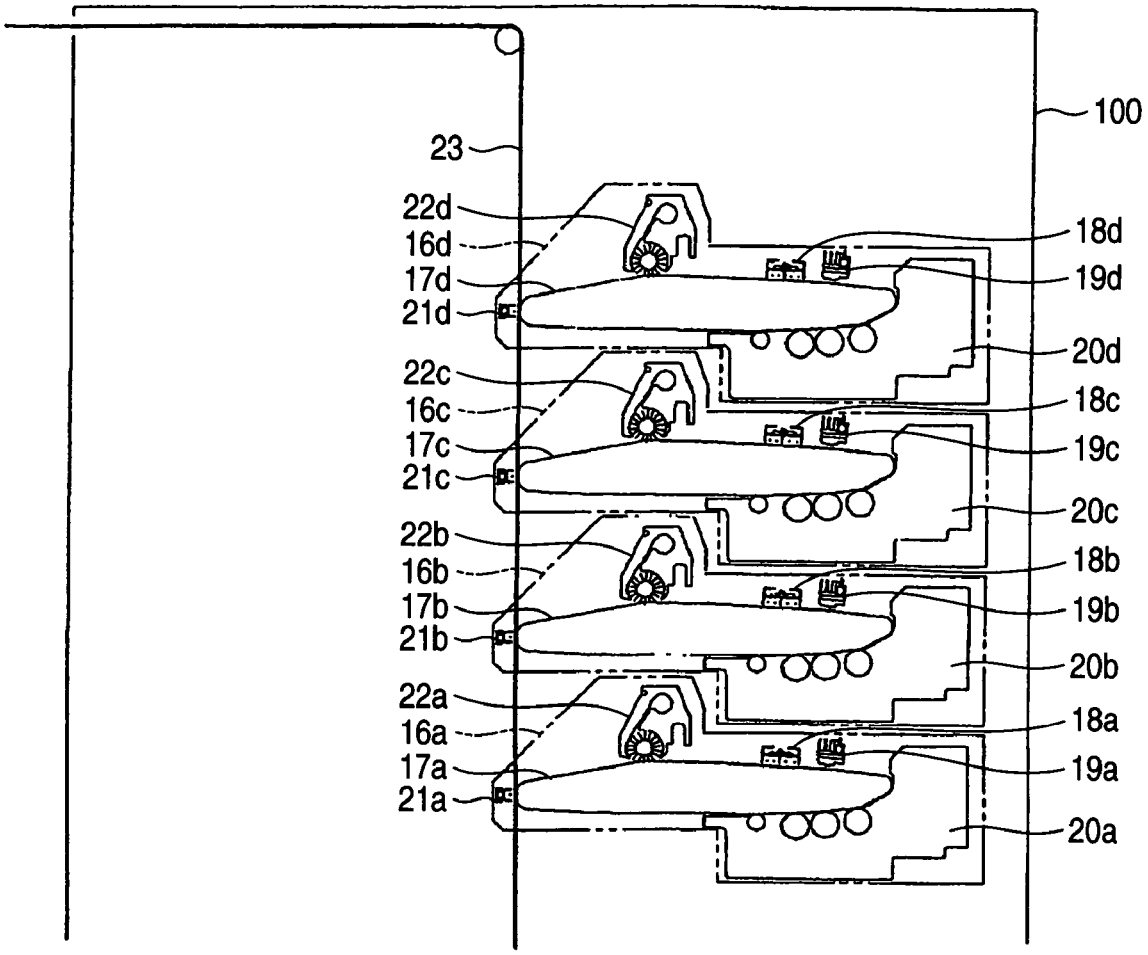
FIG. 3 is a schematic configuration diagram of an electrophotographic printing apparatus to which the invention is applied.

An overall configuration of an electrophotographic printing apparatus using belt photoconductor as shown in FIG. 1 will be described below with reference to FIG. 3.

An imaging unit 16*a* includes a belt photoconductor 17*a*, a charger 18*a*, an exposure device 19*a*, a development device 20*a*, a transfer device 21*a*, and a cleaning device 22*a*. Each of imaging units 16*b*, 16*c*, and 16*d* has the same configuration as that of the imaging unit 16*a*.

The imaging units 16*a*, 16*b*, 16*c*, and 16*d* are used for printing different colors on a sheet of paper 23. For example, the imaging unit 16*a* is used for printing yellow, the imaging unit 16*b* for printing magenta, the imaging unit 16*c* for printing cyan, and the imaging unit 16*d* for printing black.

The printing operation of the imaging unit 16*a* will be described below.

The belt photoconductor 17*a* starts rotating on the basis of a printing operation start signal given from a controller not shown. The belt photoconductor 17*a* rotates at a speed equivalent to the printing speed of the electrophotographic printing apparatus so that the rotation of the belt photoconductor 17*a* continues until the printing operation is completed. When the belt photoconductor 17*a* starts rotating, a high voltage is applied to the charger 18*a* so that a surface of the belt photoconductor 17*a* is evenly charged, for example, with positive charges.

When character/graphic data converted into dot images are transmitted from the controller not shown to the electrophotographic printing apparatus so that the dot images serve as on/off signals for the exposure device 19*a*, regions irradiated with laser light emitted from the exposure device 19*a* and regions not irradiated with the laser light are formed in the surface of the belt photoconductor 17*a*. Whenever a portion of the belt photoconductor 17*a* which have been destaticized by the irradiation with the laser light emitted from the exposure device 19*a* reach a position facing the development device 20*a*, this portion of the belt photoconductor 17*a* attracts positively charged toner by static electricity. In this manner, atoner image is formed on the belt photoconductor 17*a*. The sheet of paper 23 is transported in synchronism with the timing at which the print data formed on the belt photoconductor 17*a* reach a transfer position. The toner image formed on the belt photoconductor 17*a* is attracted onto the sheet of paper 23 by the transfer device 21*a*'s function of charging the back surface of the sheet of paper 23 with charges reverse in polarity to the toner image. Incidentally, after passing through the transfer position, the belt photoconductor 17*a* is cleaned by the cleaning device 22*a* and any residual toner on the belt photoconductor 17*a* is sucked in by a suction blower not shown and collected into a collecting portion not shown, in order to be ready for the next printing operation.

After passing through the imaging unit 16*a*, the sheet of paper 23 is subjected to similar printing operations at the imaging units 16*b*, 16*c*, and 16*d* successively and then transported to a fixing device not shown. The toner image on the sheet of paper 23 that has arrived at the fixing device is melted and fixed on the sheet of paper 23.

Each of the belt photoconductor 17*a*, 17*b*, 17*c* and 17*d* needs to be exchanged for a new one periodically, since the belt photoconductor 17*a*, 17*b*, 17*c* and 17*d* deteriorate while printing operations are repeated.

The use of the belt mounting mechanism in the invention makes it possible to reduce slackness of the belt more reliably than in the related art. Accordingly, an operator can mount the belt in the sensor easily. As a result, it is possible to prevent the belt photoconductor from being damaged and disabled before start of a printing operation.

In addition, the belt mounting guide shares the same rotating shaft with the blade for cleaning the back surface of the belt. Accordingly, the blade can be installed reliably to ensure the cleaning of the belt photoconductor during actual printing.

As described above, the invention makes it possible to mount a belt in a sensor easily without damaging the belt in spite of a simple configuration. In addition, a blade can be mounted reliably to allow a back surface of the belt to be cleaned during actual printing.

What is claimed is:

1. A belt unit of an electrophotographic printing apparatus, comprising:

two rollers for supporting a belt so as to be substantially in parallel with each other;

two frames for supporting the rollers and attached to opposite ends of one of the rollers respectively so as to be perpendicular to the rollers;

two support members attached to opposite ends of the other roller so as to be perpendicular to the rollers;

two elastic members interposed between the two support members and the two frames respectively; and a belt mounting guide provided between the two frames;

wherein the belt mounting guide includes a rotating shaft disposed in parallel with the two rollers, and an edge portion disposed along a length of the rotating shaft, the edge portion being inclined relative to an axial direction of the rotating shaft, and wherein the rotating shaft of the belt mounting guide is provided with a blade for cleaning a back surface of the belt.

2. The belt unit of an electrophotographic printing apparatus according to claim 1, wherein a step portion is provided at one end of the edge portion of the belt mounting guide and in a position where the belt travels normally.

3. The belt unit of an electrophotographic printing apparatus according to claim 1, wherein when the belt is mounted, the belt mounting guide is located to be higher than a frame that forms a slot portion included in an apparatus body in which the belt unit is mounted.

4. The belt unit of an electrophotographic printing apparatus according to claim 1, wherein the belt mounting guide is rotatably mounted to the two frames.

5. The belt unit of an electrophotographic printing apparatus according to claim 1, wherein the belt mounting guide is disposed between the two rollers.

6. An electrophotographic printing apparatus, comprising:

an apparatus body; and a belt unit installed in the apparatus body;

wherein the belt unit includes:

a belt, two rollers for supporting the belt so as to be substantially in parallel with each other, two frames for supporting the rollers and attached to opposite ends of one of the rollers respectively so as to be perpendicular to the rollers, two support members attached to opposite ends of the other roller so as to be perpendicular to the rollers, two elastic members interposed between the two support members and the two frames respectively, and a belt mounting guide provided between the two frames; and the belt mounting guide includes a rotating shaft disposed in parallel with the two rollers, and an edge portion disposed along a length of the rotating shaft, the edge portion being inclined relative to an axial direction of the rotating shaft, and wherein the rotating shaft of the belt mounting guide is provided with a blade for cleaning a back surface of the belt.

7. A belt unit of an electrophotographic printing apparatus, comprising:

two rollers for supporting a belt so as to be substantially in parallel with each other;

two frames for supporting rollers and attached to opposite ends of one of the rollers respectively so as to be perpendicular to the rollers;

two support members attached to opposite ends of the other roller so as to be perpendicular to the rollers;

two elastic members interposed between the two support members and the two frames respectively; and a belt mounting guide provided between the frames;

wherein the belt mounting guide includes a rotating shaft disposed in parallel with the two rollers, and an edge portion disposed along a length of the rotating shaft, the edge portion being inclined relative to an axial direction of the rotating shaft, and wherein the rotating shaft includes a lever to rotate the belt mounting guide to a desired position.

8. The belt unit of an electrophotographic printing apparatus according to claim 7, wherein a step portion is provided at one end of the edge portion of the belt mounting guide and in a position where the belt travels normally.

9. The belt unit of an electrophotographic printing apparatus according to claim 7, wherein when the belt is mounted, the belt mounting guide is located to be higher than a frame that forms a slot portion included in an apparatus body in which the belt unit is mounted.

10. The belt unit of an electrophotographic printing apparatus according to claim 7, wherein the belt mounting guide is rotatably mounted to the two frames.

11. The belt unit of an electrophotographic printing apparatus according to claim 7, wherein the belt mounting guide is disposed between the two rollers.

12. A belt unit of an electrophotographic printing apparatus, comprising:

two rollers for supporting a belt so as to be substantially in parallel with each other;

two frames for supporting the rollers and attached to opposite ends of the rollers respectively so as to be perpendicular to the rollers;

two support members attached to opposite ends of the other roller so as to be perpendicular to the rollers;

two elastic members interposed between the two support members and the two frames respectively; and a belt mounting guide provided between the two frames:

wherein the belt mounting guide includes a rotating shaft disposed in parallel with the two rollers, and an edge portion disposed along a length of the rotating shaft, the edge portion being inclined relative to an axial direction of the rotating shaft, wherein the two rollers comprise a drive roller and a tension roller, further comprising a rotatable shaft disposed between the two frames, the rotatable shaft having an eccentric cam disposed at opposite ends thereof.

13. The belt unit of an electrophotographic printing apparatus according to claim 12, wherein the eccentric cam is connected to the tension roller.

14. The belt unit of an electrophotographic printing apparatus according to claim 13, wherein the rotatable shaft includes a lever that rotates the eccentric cam to place tension on the tension roller.

15. The belt unit of an electrophotographic printing apparatus according to claim 12, wherein the rotatable shaft includes a lever that rotates the rotatable shaft to a desired position.

16. A belt mounting guide for a belt unit of an electrophotographic printing apparatus, comprising:

a rotating shaft being positionable in parallel between rollers of the belt unit;

a blade for cleaning a back surface of a belt; and an edge portion disposed along a length of the rotating shaft, the edge portion being inclined relative to an axial direction of the rotating shaft.

17. The belt mounting guide for a belt unit of an electrophotographic printing apparatus, according to claim 16, wherein the rotating shaft is positionable between parallel frame members of the belt unit.

18. The belt mounting guide for a belt unit of an electrophotographic printing apparatus, according to claim 17, wherein the belt mounting guide is positionable at a location higher than the parallel frame members.

19. The belt mounting guide for a belt unit of an electrophotographic printing apparatus, according to claim 17, wherein the belt mounting guide is rotatable between the parallel frame members.

20. The belt mounting guide for a belt unit of an electrophotographic printing apparatus, according to claim 16, further comprising a step portion at one end of the edge portion to receive a belt.

* * * * *